United States Patent [19]

Weidlich

[11] 4,041,837

[45] Aug. 16, 1977

[54] INDUCTION AND EXHAUST APPARATUS FOR PISTON MACHINES

[76] Inventor: Franz Weidlich, Snapphanevagen 150, 175 34 Jarfalla, Sweden

[21] Appl. No.: 664,186

[22] Filed: Mar. 5, 1976

[51] Int. Cl.[2] ..... F01L 33/02; F15B 13/04

[52] U.S. Cl. ..... 91/270; 91/450; 123/53 R; 123/80 R; 123/190 A; 137/625.21

[58] Field of Search ..... 91/456, 270, 450; 137/625.21, 625.23, 596; 123/190 R, 190 A, 190 B, 190 BD, 53 R, 80 R; 418/61 A

[56] References Cited

U.S. PATENT DOCUMENTS

| | | | |
|---|---|---|---|
| 973,800 | 10/1910 | McKinnon | 123/190 A |
| 2,183,024 | 12/1939 | Large | 123/190 A |
| 2,907,349 | 10/1959 | White | 137/625.23 |
| 3,382,849 | 5/1968 | Chaude | 91/270 X |
| 3,405,692 | 10/1968 | Paschke | 418/61 A |
| 3,875,967 | 4/1975 | deFries | 137/625.21 X |
| 3,893,483 | 7/1975 | Ackerman | 133/625.21 |
| 3,896,781 | 7/1975 | Smith | 123/190 A |
| 3,945,364 | 3/1976 | Cook | 123/190 BD |

*Primary Examiner*—Irwin C. Cohen
*Attorney, Agent, or Firm*—Kurt Kelman

[57] ABSTRACT

The four strokes of a piston in an internal combustion engine are sequentially controlled by two rotary valves, each including a housing and a triangularly shaped rotor mounted in the housing for epitrochoidal movement. The rotor defines three chambers in the housing and a duct connects respective ports in the housing of each valve to the working chamber of an engine cylinder. The engine drive shaft is so synchronized with the rotary movement of the rotors that, for each complete stroke, one chamber in the housings is in communication with the cylinder chamber through the duct, while the intake and exhaust ports in the housing of the first valve are selectively in and out of communication with the one chamber. A surface of the rotors is exposed to gases coming from the cylinder chamber during the power stroke so that these gases contribute to the rotary movement of the rotors.

7 Claims, 8 Drawing Figures

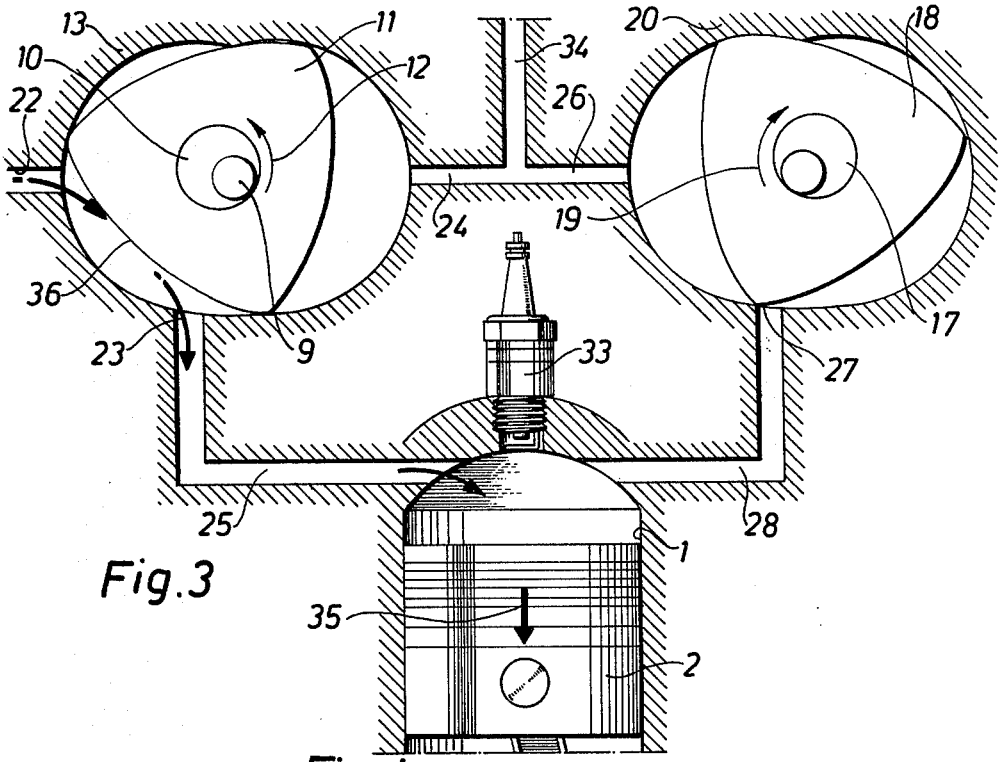
Fig.3
Fig.4
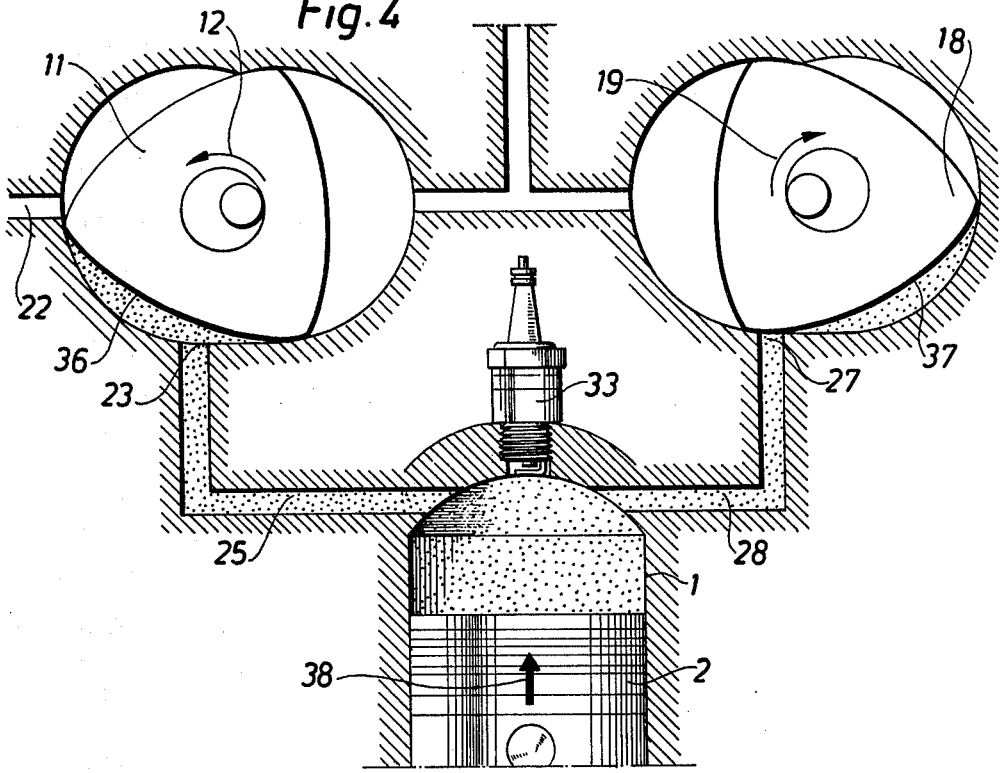

INDUCTION AND EXHAUST APPARATUS FOR PISTON MACHINES

The invention relates to fuel intake and exhaust apparatus for four-stroke internal combustion piston engines. The fuel flow cycle to such engines is controlled in response to the piston movement.

In ordinary piston machines, especially internal combustion piston engines, the intake of fuel gases and exhaust of combusted products is generally controlled by valve mechanisms which are mounted in the cylinder head. Conventional valves have the drawback of being subject to heavy wear, in spite of their being manufactured from expensive materials. For driving the valve mechanisms, it is further necessary to take power from the engine, which means that the power delivered by the engine is reduced by the valve mechanisms.

The object of the invention is to provide the intake and exhaust apparatus for piston machines, which render the use of conventional valves superfluous.

This object is accomplished according to the invention by apparatus which is provided with rotors having such a design and arrangement that the intake, compression, power and exhaust stroke cycles of a piston engine are controlled by rotating the rotors, there being intake and exhaust ducts opening into the combustion chamber of the cylinder of the associated piston.

Each rotor has a surface configuration designed so that it can alternatingly uncover a connecting duct between the the intake system and the combustion chamber, seal off the combustion chamber during compression and working strokes and uncover a duct between the exhaust system and the combustion chamber in a continuous rotary movement. With this object in view, each rotor is therefore designed so that defining surfaces thereof engage with defining surfaces in a housing in which the rotor is mounted.

The defining surfaces of each rotor can advantageously be designed so that exhaust gases coming from the combustion chamber have a driving effect on the rotor during the exhaust stroke. These exhaust gases hereby provide a source of power for driving the intake and exhaust apparatus according to the invention.

Due to the configuration of its defining surfaces and its rotation, the inlet rotor creates a negative pressure on the intake side, thereby causing the delivered fuel mixture to flow more rapidly into the combustion chamber.

In a four-stroke engine each cylinder is provided with two rotors, one for the fuel intake and the other for exhaust. Each rotor is mounted on a cam attached to a shaft running with half the rotary speed of the engine. The rotors can be driven in the same or opposing directions. When the intake and exhaust openings in the combustion chamber are on the same side the rotors are driven in opposite directions. In a preferred embodiment of the invention, the shaft or shafts are driven by conventional means such as a chain drive or gears from the crankshaft of the engine.

Rotors serving individual strokes in a working machine, e.g. an internal combustion engine, are arranged in a closed chamber above the cylinders, to form the cylinder head, thus replacing the valve mechanisms used up to now which are very sensitive to interference in spite of the high quality materials used for them. Since the exhaust gases have a driving effect on the rotor, thus acting as an extra source of power, power output is only reduced to a minor degree by the power required to drive the rotors. Even this reduction is offset by the action of the rotor on incoming combustion gas, since as previously mentioned the rotor has a pumping effect which increases the flow of gas mixture into the combustion chamber, causing it to fill quickly and thereby increasing the performance of the engine.

As has been mentioned above, an arrangement according to the present invention has two rotors per working piston of the internal combustion engine. This allows, inter alia, also such advantages as overlap in connection with the initial phase of the intake stroke. In conventional valve control of the strokes in a piston engine it is usual, towards the end of the exhaust stroke, to allow the inlet valve to start opening, thereby obtaining extra intake assistance from the rapidly outflowing exhaust gases. The same effect can be achieved by the present invention.

The invention will further be described in connection with the accompanying drawings showing schematically embodiments of the invention.

FIGS. 3–7 show different positions in the working cycles of the rotary controlling means in association with the appropriate engine piston.

Figure 1:
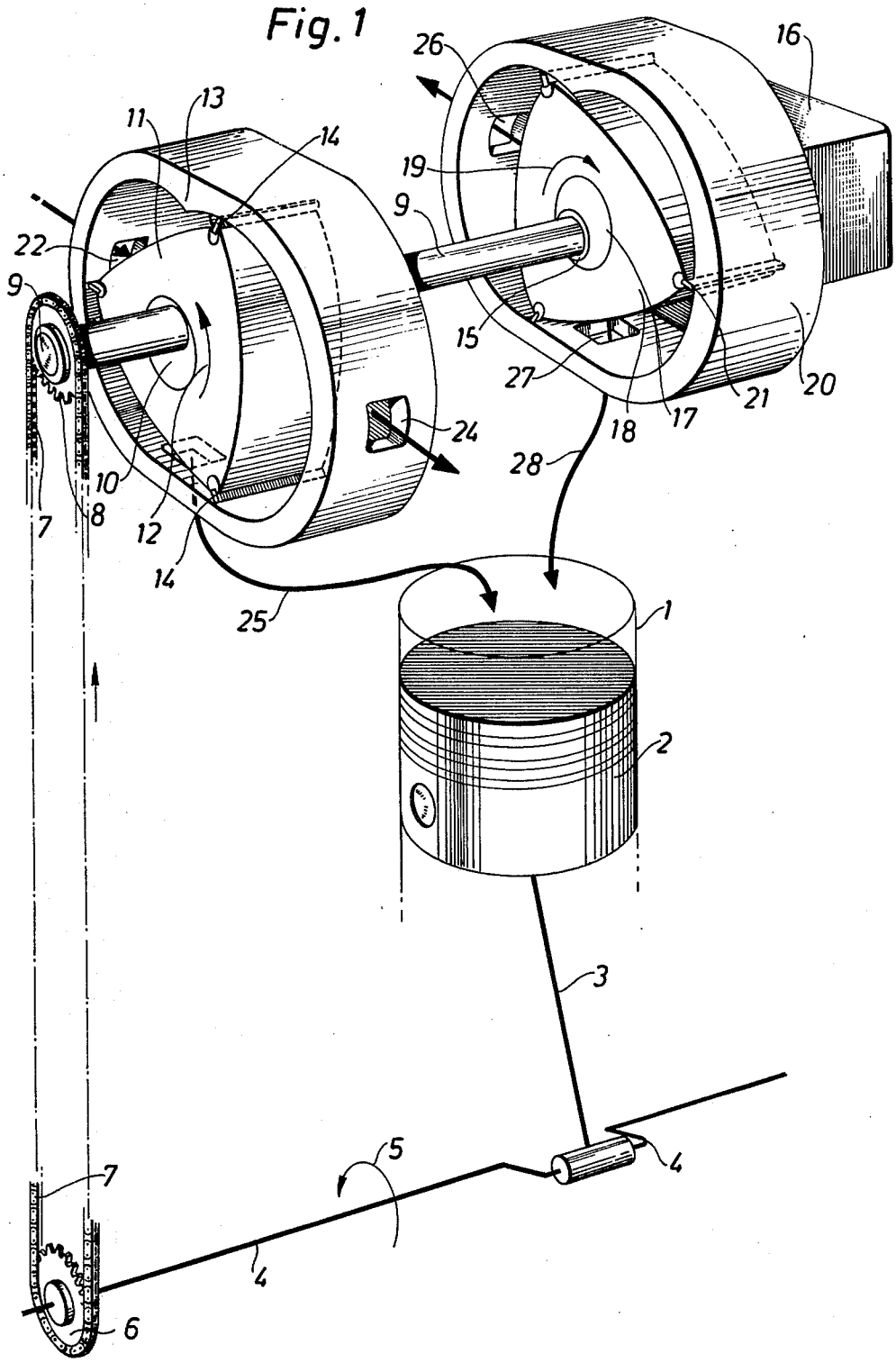
FIG. 1 shows schematically and in perspective an engine cylinder with piston and the rotary controlling means for the stroke cycles associated herewith.

In FIG. 1 is shown a cylinder 1 with a piston 2 attached to carnkshaft 4 by means of a connecting rod 3. The crankshaft is assumed to rotate in the direction of the arrow 5. The shaft 4 is provided with a pinion 6 driving a chain 7, which in its turn drives a further pinion 8 attached to a shaft 9. The latter shaft is provided with cam 10 driving a rotor 11 in the direction of the arrow 12 in a manner known per se. The rotor is arranged to execute an epitrochoid path within a housing 13, which is prior art, the rotor being provided with means 14 sealing against the inside of the housing. The shaft 9 passes freely through a sleeve 15 to a gearbox 16, not shown in detail in FIG. 1. The sleeve 15, concentric with the shaft 9, is arranged to carry a further cam 17 driving a further rotor 18 in the direction of the arrow 19, i.e. opposite to that of the rotor 11. The rotor 18 runs in a housing 20, sealing against the inside thereof with the aid of sealing means 21. The housing 13 is provided with three openings 22, 23 and 24. The opening 23 is in communication with the cylinder 1. This is schematically denoted only by the arrow 25 in order not to complicate the drawing. The housing 20 is provided with openings 26 and 27, the latter opening also being in communication with the cylinder 1 as indicated by the arrow 28 also in order not to complicate the drawing. The coaction between rotors, piston and openings will be more closely described below.

Figure 2:
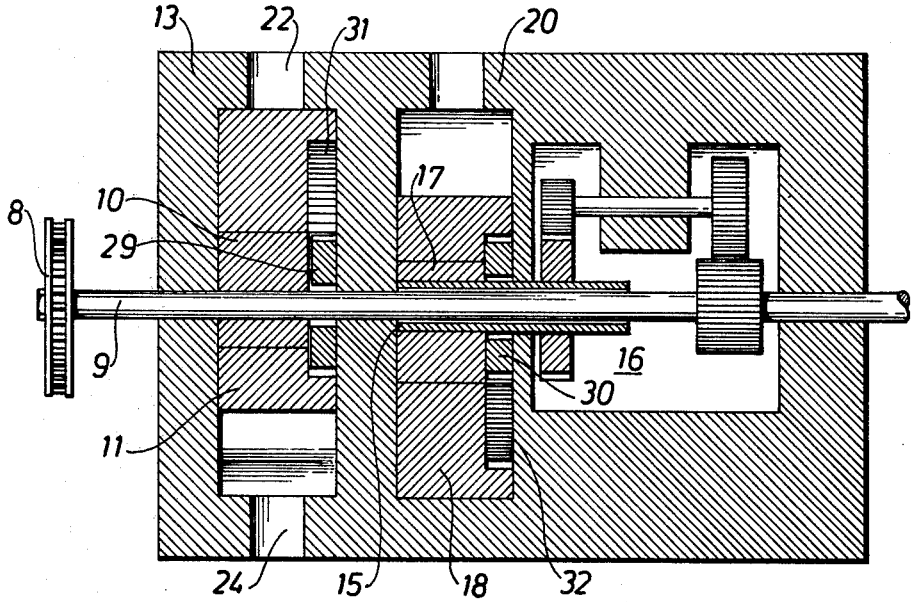
FIG. 2 shows a section through an assembly of two such rotary controlling means.

In FIG. 2 there are shown the details hereinbefore described in conjunction with the rotors assembled in the device. Fixed gear wheels 29 and 30 for the respective rotor coact with meshing toothed rims 31 and 32 in order to obtain the epitrochoid movements thereof. As is also shown in the FIGURE, the gearbox 16 contains a simple reversing gear with the same input and output revolutions driving the rotor 18 in the opposite direction relatively to the rotor 11.

As shown in FIGS. 3 to 8, the upper portion or combustion chamber of the cylinder 1 is provided with a spark plug 33. For the remainder, there are all the ducts and communications described in FIG. 1. It should be pointed out that the outlets 24 and 26 constituting the exhaust outlets are coupled together into a common outlet 34. The opening 22 in the housing 13 is connected to the duct from the carburetter. The gear ratio between the crankshaft 4 and the shaft 9 is such that, for two revolutions of the crankshaft 4, the shaft 9 only rotates through a third of a revolution.

The apparatus functions in the following manner, FIG. 3 being first referred to.

It is assumed that the piston 2 is moving downward in the direction of the arrow 35. The rotor 11 is then in such a position that it allows free flow of a fuel-air mixture through intake opening 22 and the chamber formed between the interior of the housing 13 and side surface 36 of the rotor, and further through the opening 23 and the canal 25 into the cylinder 1. At the same time, the rotor 18 is in such a position that it cuts off the connection between the openings 27 and 26, the cylinder 1 by means of the duct 28 only being in communication with the chamber formed by the inside of the housing 20 and one side surface 37 of the rotor 18.

When the piston 2 has reached its bottom position, the rotor 11 has rotated past intake opening 22, e.g. the sealing means 14, 21 close all exits for the cylinder 1 at the beginning of the compression stroke, as shown in FIG. 4. The piston is now moving upwardly in the direction of the arrow 38.

Figure 5:
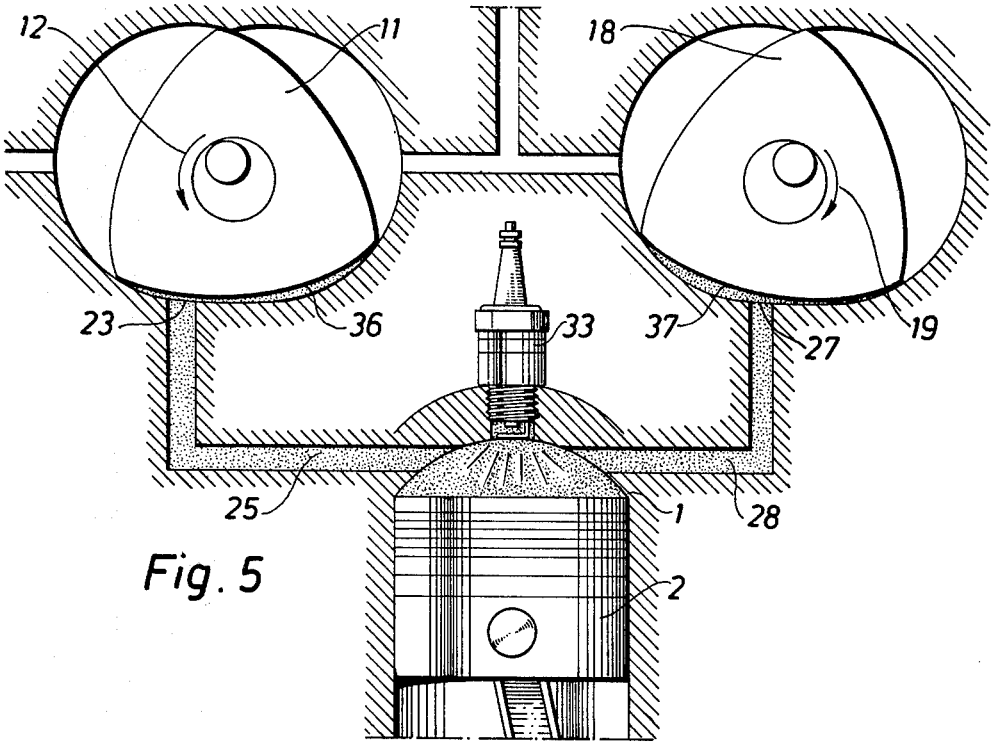

As is apparent from FIG. 5, the rotors 11 and 18 assume such positions when ignition occurs that the gas pressure exercised on them on combustion imparts rotational force in their respective directions of rotation.

The resultant force of the prevailing pressure is eccentric to the center of rotation in question.

Forces in question act on the same sides of the rotors, i.e. the sides 36 and 37, which have been in communication with the cylinder during the working stroke in question.

During the expansion of the combusting gases and the downward movement of the piston 2, the rotors 11 and 18 will rotate in their respective rotational directions 12 and 19 under driven conditions.

Figure 6:
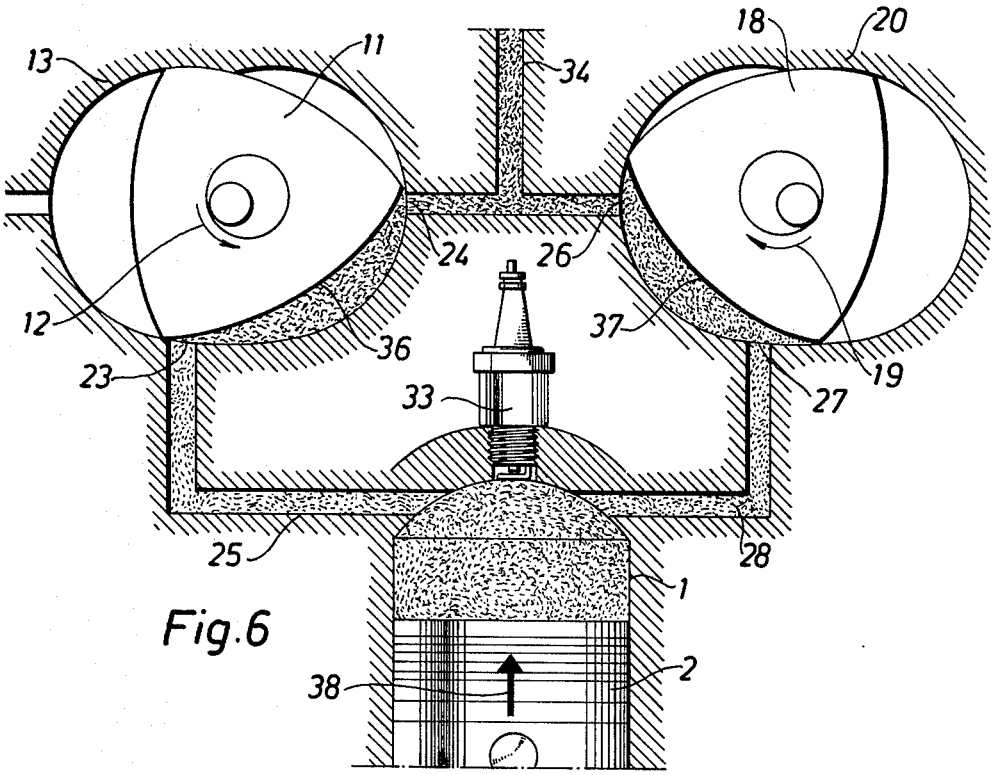

When the piston 2 has reached its bottom position once again, as shown in FIG. 6, the rotors 11 and 18 have rotated so that they open the connection between the cylinder 1 and the exhaust gas outlet 34, partly via the canal 25, the opening 23 and the chamber between the housing 3 and the rotor surface 36 to the exhaust opening 24, and partly through the canal 28, the opening 27 and the chamber which is formed between the surface 37 of the rotor 18 and the housing 20 to the opening 26. During the movement of the piston in the direction of the arrow 38, exhaust will take place via the communications just mentioned.

Figure 7:
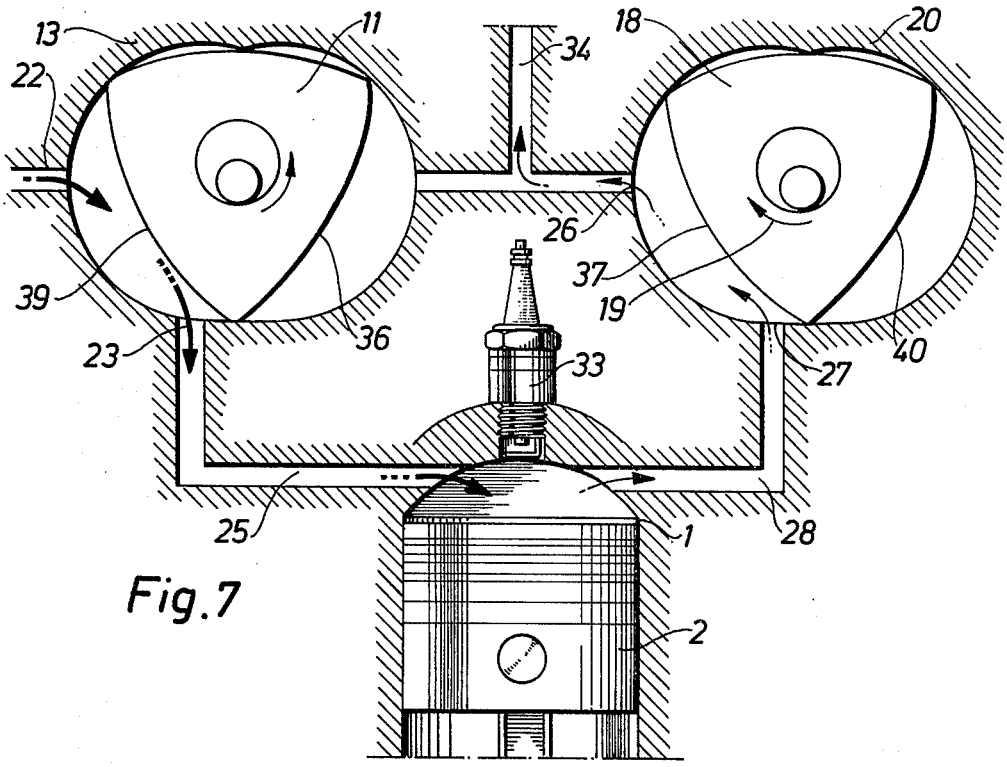
Figure 8:
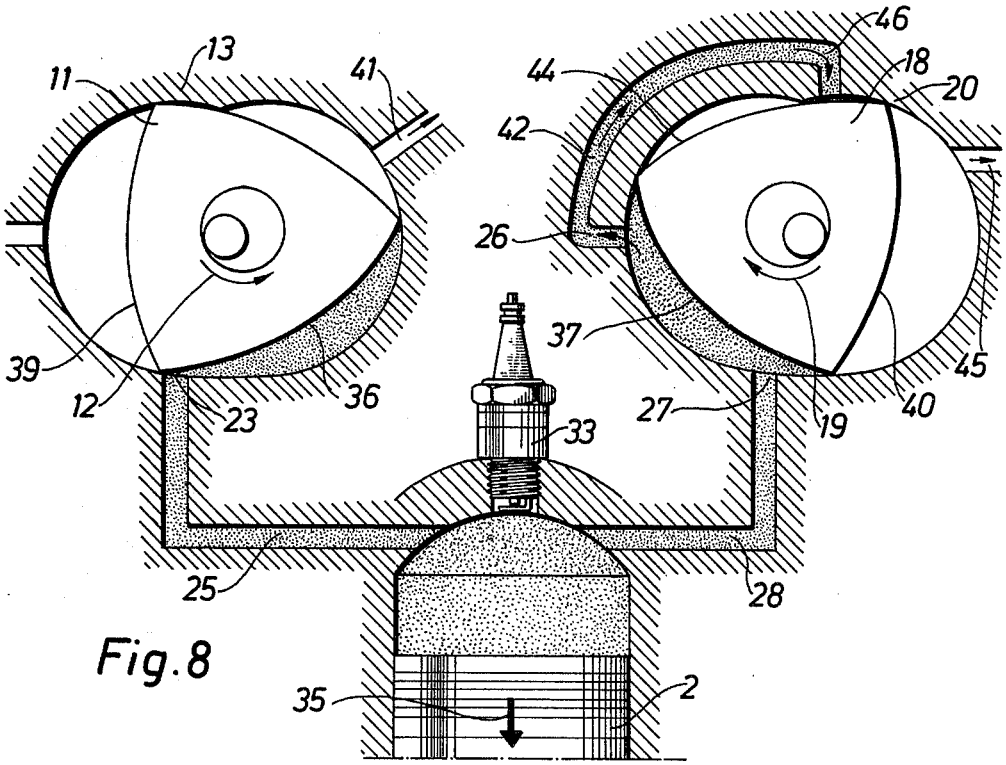
FIG. 8 shows a modified embodiment.

Towards the end of the exhaust stroke, i.e. when the piston 2 is near its top position, the rotors 11 and 18 have assumed a position shown in FIG. 7. As may be seen the connection between the cylinder and outlet 34 is open via the communications 28, 27, 26 as previously for the rotor 18, while the rotor 11 has assumed a position whereby communication between the cylinder and the intake side is now open via the openings 22, 23, the chamber formed by a second surface 39 of the rotor 11 and the housing 13 to the canal 25. Further to the "rotary pump" effect previously mentioned, the incoming fuel-air mixture is further helped into the cylinder by the depression caused when the combustion gas residue is exhausted under the effect of its binetic energy. So-called overlapping has hereby been accomplished, i.e. both the intake and exhaust sides are open simultaneously, which is normal practice in conventional valve arrangements. By displacing the setting of the rotors 11 and 18 in relation to each other, a varying amount of overlap can be provided. This setting can be made by suitable adjustment of the gear wheel setting in the reversing gear box 16.

When the piston 2, after the position shown in FIG. 7 once more begins to move downwards, the whole working cycle is repeated starting from FIG. 3. However a second surface 40 of the rotor 18 will be exposed to the gases in the cylinder 1. During a substantial part of the time taken by the four stroke cycles of the piston 2, one working surface of each rotor is exposed in turn to communication with the cylinder 1. The result of this is that, when the crankshaft 4 has rotated six revolutions, the respective rotors have each rotated one complete revolution.

If it is desired more effectively to utilize the driving force provided by the exhaust gases to rotate the rotors at a decreasing pressure as the piston 2 moves downwards, larger surfaces of the rotors should be exposed to the gas. This is accomplished in an embodiment according to FIG. 8. The outlet openings are here connected to canals 41 and 42 respectively. The canal 41 opens directly out into the exhaust manifold (not shown) the canal 42 opening into a chamber 43 formed by the housing 20 and the third surface 44 of the rotor 18. The expanding gases will hereby act on two surfaces for each rotor, i.e. the surfaces 37 and 44 for the rotor 18. To provide an outlet for the exhaust gases shortly after the gases have flowed into the last-mentioned chamber through the canal 42, an outlet canal 45 is arranged in the housing 20. After the piston 2 has reached bottom, the rotors 11 or 18 have rotated so that there is a free passage to the outlets 41 and 45.

This last described embodiment can be applied when using only one rotor for controlling the gases to the cylinder 1. Many embodiments can be conceived within the scope of the inventive idea, and the assembly hereinbefore described schematically can be varied to a great extent in view of requirements occurring in practice.

What I claim is:

1. In combination with a cylinder of a four-stroke piston engine, the cylinder having a reciprocating working piston defining a working chamber therewith and a drive shaft connected to the piston: a device for sequentially controlling an intake, compression, power and exhaust stroke of the piston, the device comprising a. a first and a second rotary valve means, each of the valve means including
   1. a housing with an epitrochoidal shaped cavity having ports and
   2. a triangularly shaped rotor supported in said cavity or epitrochoidal movement, the rotor having three surfaces defining respective chambers with the housing,
   3. the ports in the housing of the first rotary valve means including an intake and an exhaust port, the ports in the housing of the second rotary valve means including an exhaust port, and an additional one of the ports in each of the housings serving for connection of one of the chambers to the working chamber of the cylinder, b. duct means connecting the additional ports to the working chamber, and c. synchronizing means connecting the drive shaft and the rotors for synchronizing the rotation of the drive shaft with that of the rotors, the synchronizing means including 1. reduction gearing causing the rotors to move so that, for each complete stroke, the one chamber in the housings is in communication with the working chamber of the cylinder through the duct means, the intake and the exhaust ports in the housing of the first valve means are selectively in and out of communication with the one chamber, the exhaust port in the housing of the second valve means is selectively in and out of communication with the one chamber, and such a surface of the rotors is exposed to gases coming from the working chamber of the cylinder during the power stroke that the gases contribute to the rotary movement of the rotors.

2. In the combination of claim 1, the intake and additional ports in the housing of the first valve means being in communication through the one chamber during the intake stroke, the exhaust and additional port in the housing of the first valve means being in communication with the one chamber during the exhaust stroke, and the additional port and exhaust ports in the housing of the second valve means being in communication during the exhaust stroke.

3. In the combination of claim 1, the rotors being angularly displaced so that, during the latter part of the exhaust stroke, the additional ports in the housings of the first and second valve means are simultaneously in communication with the respective exhaust ports.

4. In the combination of claim 3, the rotors being mounted for rotation in opposite directions.

5. In the combination of claim 4, a common shaft driving the rotors of the first and second valve means, the common shaft being in driving connection with the drive shaft.

6. In the combination of claim 5, a reversing gear connecting the rotor in the second valve means to the common shaft.

7. In the combination of claim 1, a further duct interconnecting the exhaust port in the housing of the second valve means with another port in said housing, the rotor in the second valve means being positioned at the end of the power stroke so as to place the exhaust port and the other port in communication through the further duct.

* * * * *